US005113624A

United States Patent [19]

Dawson

[11] Patent Number: 5,113,624

[45] Date of Patent: May 19, 1992

[54] GRINDING NON-METALLIC HARD MATERIALS

[75] Inventor: Derek J. Dawson, Bradford, England

[73] Assignee: T&N Technology Limited, England

[21] Appl. No.: 593,731

[22] Filed: Oct. 5, 1990

[30] Foreign Application Priority Data

Oct. 7, 1989 [GB] United Kingdom ..... 8922640

[51] Int. Cl.[5] ..... B24B 1/00

[52] U.S. Cl. ..... 51/325; 51/326; 125/11.01

[58] Field of Search ..... 51/325, 326, 327, 281 R, 51/287, 206 R, 206 P, 52 R; 125/11.01, 11.03, 11.04

[56] References Cited

U.S. PATENT DOCUMENTS 3,299,579 1/1967 Jacobson ..... 51/209 R
3,904,391 1/1975 Lindstrom et al. ..... 51/295

FOREIGN PATENT DOCUMENTS 0982881 12/1982 U.S.S.R. ..... 125/11.04

*Primary Examiner*—Bruce M. Kisliuk
*Assistant Examiner*—Eileen Morgan
*Attorney, Agent, or Firm*—Nixon & Vanderhye

[57] ABSTRACT

In one method of cross-grinding in accordance with the present invention a non-planar surface on a workpiece, of a non-metallic material having a Vickers hardness value up to 5000, comprises, in each of two grinding steps, traversing the rotational axis of a grinding wheel along a predetermined axis, relative to the workpiece surface. In the first step the radially extending plane of the grinding wheel includes the predetermined axis, and the required workpiece surface is produced with inevitable ridges. For the second grinding step the working surface of the same, or different, grinding wheel is shaped by a tool capable of shaping in a normal manner the working surface suitable for the first grinding step. However, the working surface of the grinding wheel is altered by the radially extending plane of the wheel when presented to the tool being inclined in one sense at a selected angle, in the range 1° to 20°, to the direction of this plane if presented to the tool to obtain the shape suitable for the first grinding step. In the second grinding step the ridges on the workpiece are reduced by the radially extending plane of the wheel with said altered working surface being inclined in said one sense at the selected angle to the orientation of the radially extending plane of the grinding wheel in the first grinding step.

9 Claims, 3 Drawing Sheets

GRINDING NON-METALLIC HARD MATERIALS

BACKGROUND OF THE INVENTION

This invention relates to the grinding of non-metallic hard materials, each having a Vickers hardness value up to 5000, and in particular to a method of grinding a non-planar surface on to a workpiece of such a material by employing a rotating grinding wheel.

The term "non-metallic" is employed in this specification and the accompanying claims to refer to any composition not comprising a metallic element, or an alloy of metallic elements, but possibly having at least some of the properties associated with a metallic element, or an alloy of metallic elements. Further, a surface on a workpiece of any such non-metallic composition is ground by the disintegration of the surface thereof, and the removal of small particles therefrom.

The invention relates particularly to a method of grinding a required non-planar surface on to a workpiece of a non-metallic hard material, in which method the axis of rotation of the grinding wheel used is caused to traverse along a predetermined axis relative to the surface of the workpiece blank so that the grinding wheel passes through a portion of the workpiece. It is known for the rotational axis either to reciprocate in the plane containing all the radii of the wheel (hereinafter called "the radially extending plane"), or to move only in one linear direction in this plane, relative to the workpiece surface, the predetermined axis lying in this plane. The wheel traverses relatively to the workpiece until the wheel has cut the full depth of its form into, the workpiece. Hence, any undesired features in the required non-planar workpiece surface caused by imperfections of the grinding wheel extend linearly parallel to the predetermined axis, and to the radially extending plane of the grinding wheel.

It is also known that the required shape of the working surface of the grinding wheel is shaped by a tool with a complementary shape. The tool is required to pass through the wheel by traversing relatively to the wheel. The normal method of presentation is for the wheel to reciprocate relatively to the tool until the tool has cut the full depth of its form into the wheel. In particular, the present invention relates to a grinding method including such a method of shaping the working surface of the grinding wheel with a tool.

Usually the rotating grinding wheel has the appropriately shaped working surface, comprising the radially outer periphery of the wheel, formed from gemstone, or synthetic diamond, particles bonded to a suitable substrate.

A grinding wheel having a working surface of gemstone, or synthetic diamond, particles inevitably provides a surface on the workpiece with undesired grooves, having ridges therebetween. The ridges extend parallel to the direction of traverse of the axis of rotation of the wheel relative to the workpiece surface. This is because the particles have different sizes, and there is insufficient control over the way in which the particles are embedded in the working surface of the grinding wheel. The working surface is, thus, irregular with particles protruding therefrom by different amounts from what can be considered to be the general level of the working surface. The finish of such a working surface, conveniently, can be defined by the maximum amount of protrusion of the diamond particles from the general level of the working surface, such maximum particle protrusion being greater for a relatively coarsely finished working surface than for a relatively finely finished working surface.

It is known that, if the required workpiece surface is to be as flat as possible, the height of the ridges may, in the case of a planar surface, be at least reduced by cross-grinding in a direction at right angles to the direction of the initial grinding action. However, in grinding a non-planar workpiece surface such cross-grinding cannot be employed.

It is an object of the present invention to provide novel and advantageous method of grinding, in which method the height of ridges normally inevitably formed on the workpiece surface, can at least be reduced.

BRIEF SUMMARY OF THE INVENTION

The invention provides a method of grinding a required non-planar surface on to a workpiece made of non-metallic material and having a Vickers hardness value up to 5000, the method comprising a first and a second grinding step in each of which a grinding wheel, having a working surface of particles of a material selected from the group of gemstone and synthetic diamond, is applied to the workpiece with the grinding wheel having a rotational axis which is traversed along a predetermined axis relative to the workpiece;

in the first grinding step, the grinding wheel being traversed with the predetermined axis lying in a radially extending plane of the grinding wheel, and the grinding wheel having a working surface which has an appropriate form such that the workpiece is ground to a non-planar surface which is substantially the required non-planar surface with ridges thereon; and in the second grinding step, the grinding wheel having a working surface which has been shaped by a tool, the tool having a shaping surface which, if the tool were presented with an axis of traverse of the wheel relative to the tool lying in a radially extending plane of the wheel, would shape the working surface to the appropriate form aforementioned, the tool, however, being presented with the radially extending plane of the grinding wheel inclined at a selected angle in the range 1 degree to 20 degrees to the axis of traverse of the wheel relative to the tool, and, in the second grinding step, the radially extending plane of the wheel being inclined at said selected angle to the inclination of the radially extending plane of the grinding wheel during the first grinding step.

Previously, it has not been known to grind with the radially extending plane of the grinding wheel inclined to the axis of traverse of the wheel relative to the workpiece. Also, it has not been known previously to incline the radially extending plane of the grinding wheel to the axis of traverse of the wheel relative to a tool to shape the working surface of the tool.

The desired shape of a grinding wheel when employed in the first grinding step may be shaped by employing an appropriately shaped tool in the manner referred to above for the normal presentation of the wheel to the tool.

The desired shape of a grinding wheel when employed in the second grinding step may be shaped either by arranging that, with an appropriately shaped tool, the radially extending plane of the wheel is inclined at the selected angle to the axis of traverse of the wheel relative to the tool, and with the axis of traverse of the wheel relative to the tool being parallel to the axis of traverse of the wheel relative to the workpiece; or by employing a differently shaped tool in the manner referred to above for the normal presentation of the wheel to the tool, but with the axis of traverse of the wheel relative to the tool being inclined at the selected angle to the axis of traverse of the wheel relative to the workpiece.

The same grinding wheel as is employed in the first grinding step may be employed also in the second grinding step, if the working surface of the wheel is readily capable of being re-shaped and has the desired finish for the working surface of the grinding wheel to be employed in the second grinding step. Otherwise different grinding wheels are employed in the two grinding steps, the working surface of the wheel to be employed in the second grinding step possibly having a relatively finer finish than the working surface of the wheel to be employed in the first grinding step.

Because the working surface of the grinding wheel used in the second grinding step has different particles protruding therefrom than that used in the first grinding step, the working surface is caused to enter and, by grinding, to reduce the height of the ridges. The arrangement is required to be such that it is unimportant if, in the second grinding step, the grinding wheel enters the side walls of protrusions, and/or depressions, of the non-planar workpiece surface previously formed in the first grinding step.

BRIEF DESCRIPTION OF THE DRAWINGS

The present invention will now be described by way of example with reference to the accompanying drawings, in which.

DETAILED DESCRIPTION OF PREFERRED EMBODIMENT OF THE INVENTION

Figure 1:
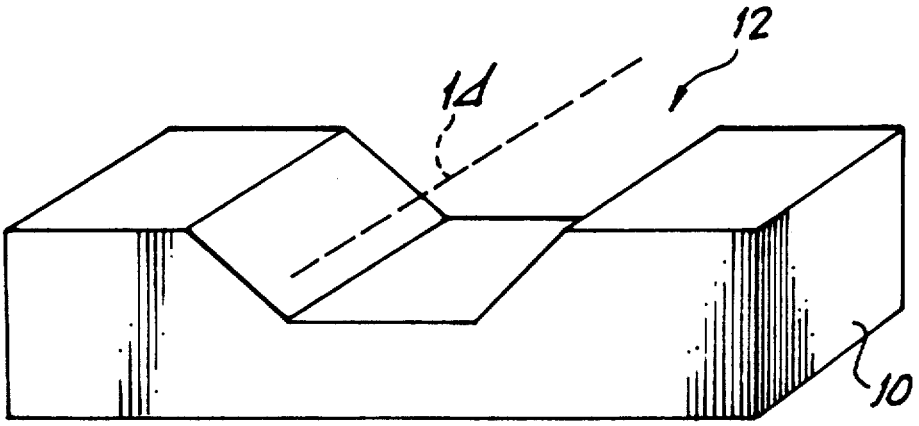
FIG. 1 is a perspective view of a non-planar surface required to be produced on a workpiece of a non-metallic hard material, by a grinding method, employing a rotating grinding wheel, or wheels, in accordance with the present invention, the method being illustrated by FIGS. 2 to 6.

The workpiece 10 shown in FIG. 1 is of sintered silicon nitride, having a Vickers hardness value of approximately 2000. Shown in FIG. 1 is a non-planar surface, indicated generally at 12, required to be formed on the workpiece blank. The illustrated workpiece surface 12 is provided by a linearly extending, truncated "V-shaped" depression to be ground in the workpiece blank, and the depression is bounded on either side of its longitudinally extending axis by two planar, ground, portions of the non-planar surface, each such planar portion having a uniform width. The longitudinally extending axis of the depression, conveniently, can be considered to be a predetermined axis of the workpiece surface 12, and is indicated in FIG. 1 by the broken line 14.

Figure 3:
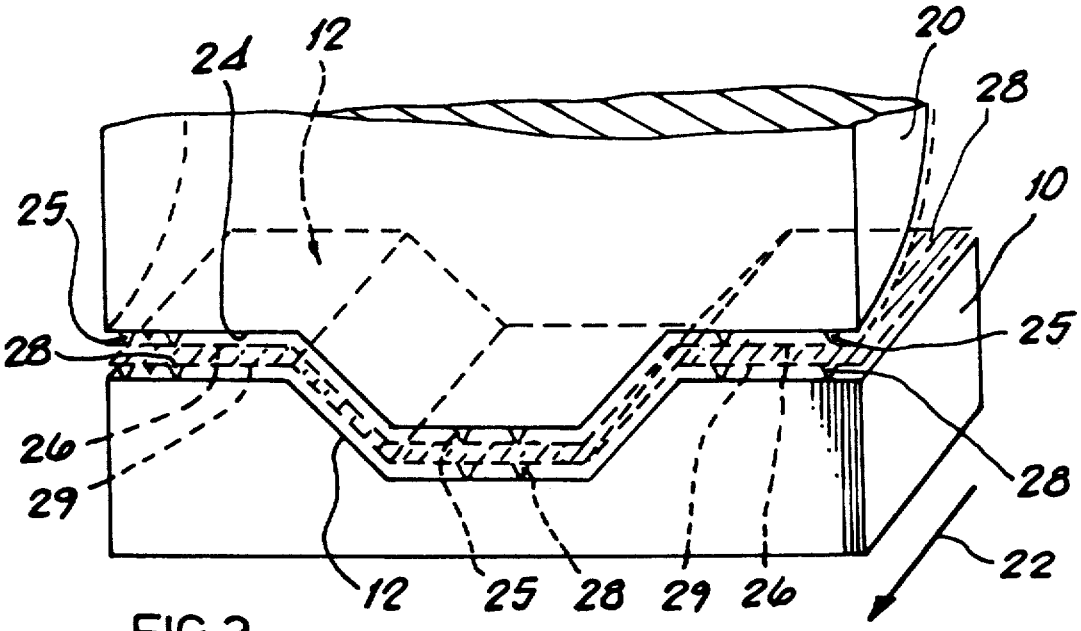
FIGS. 2 and 3 and substrate a first grinding step of the method, re 2 being a plan view, and FIG. 3 being a perspective view, both these FIGS. indicating the manner in which the rotational axis of a grinding wheel traverses, relative to a workpiece surface, along a predetermined axis, the predetermined axis lying in the radially extending plane of the wheel, only part of the wheel being shown in FIG. 3 and this part being shown sectioned in a plane at right angles to the predetermined axis and including the rotational axis of the wheel, in particular, this FIG. shows ridges inevitably are formed on the workpiece surface.
Figure 2:
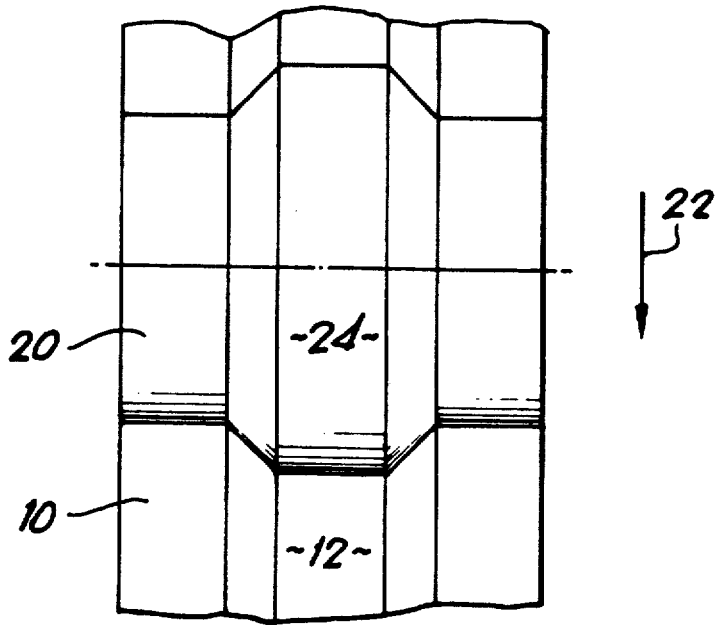

The first step of a method of grinding the surface 12 in accordance with the present invention is indicated in FIGS. 2 and 3 and is the same as a known method of grinding. In these FIGS., a direction parallel to the predetermined axis 14 of FIG. 1 is indicated by an arrow 22, and for the sake of clarity the predetermined axis 14 is not indicated. A grinding wheel 20, only partially shown in FIG. 3, has a radially extending plane including the predetermined axis 14. FIG. 2 comprises a plan view of the grinding wheel 20 operating on the workpiece surface 12, and FIG. 3 is a corresponding perspective view. The illustrated portion of the grinding wheel 20 in FIG. 3 is shown sectioned in a plane, at right angles to the predetermined axis, and including the rotational axis of the wheel, both not shown. Also for the sake of clarity the sectioned plane of the grinding wheel 20 is not hatched, and the portion of the workpiece 10 behind the grinding wheel 20, and otherwise in the background of the perspective view, is indicated in broken line form.

Also as shown in FIG. 3, the working surface 24 of the grinding wheel 20 is provided by gemstone, or synthetic diamond, powder embedded in a suitable substrate. Because the particles 25 of the powder have different sizes, and because of insufficient control over the way in which the particles 25 are embedded in the working surface 24, inevitably the working surface is irregular with particles 25 protruding therefrom. The particles 25 protrude by different amounts from the general level of the working surface 24. The maximum amount of such particle protrusion, in greatly exaggerated form, is indicated by the broken line 26, this maximum amount defining the finish of the working surface 24.

As indicated by both FIGS. 2 and 3 the rotational axis of the grinding wheel 20 is caused to traverse, relative to the workpiece surface 12, parallel to the arrow 22 and along the predetermined axis 14 shown in FIG. 1, the direction of traverse being included in the radially extending plane of the wheel. The working surface 24 of the wheel 20 is appropriately formed so that, by the traversing of the rotational axis, the required non-planar surface 12 of the workpiece 10 is provided with ridges thereon, some of which ridges being indicated at 28. The ridges 28 inevitably are formed on the ground surface 12. The ridges 28 are formed because of the protrusion of some of the diamond particles 25 from the general level of the working surface 24 of the grinding wheel 20. Because of the traversing, relative to the workpiece surface 12, of the rotational axis of the wheel 20 along the predetermined axis 14 of the workpiece surface 12, the ridges 28 extend parallel to the predetermined axis. The limit of the height of the ridges 28, also in greatly exaggerated form, is indicated by the broken line 29.

Because the required workpiece surface 12 is non-planar, it is not possible to reduce the height of the ridges 28 formed thereon by cross-grinding the surface 12 at right angles to the predetermined axis 14 and the arrow 22.

In the method in accordance with the present invention there is performed a second grinding step in the manner described below.

Figure 6:
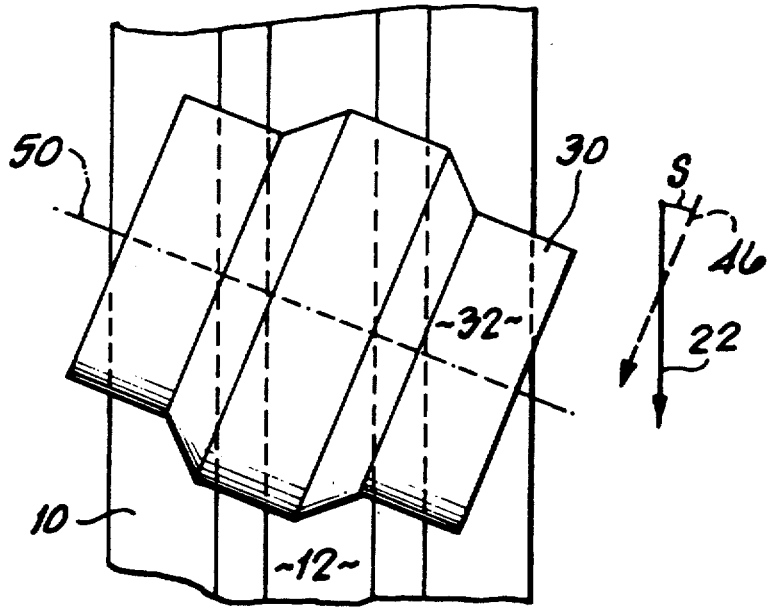
FIG. 6, corresponds to FIG. 2, but illustrates the second grinding step, by indicating that the rotational axis of the wheel of FIGS. 4, and 5, traverses, relative to the workpiece surface, along the predetermined axis, but the radially extending plane of the wheel is inclined in said one sense at the selected angle to the orientation of the radially extending plane in the first grinding step of FIG. 2, so that the ridges are reduced, but otherwise the non-planar shape of the workpiece surface provided by the first grinding step is not significantly affected.
Figure 4:
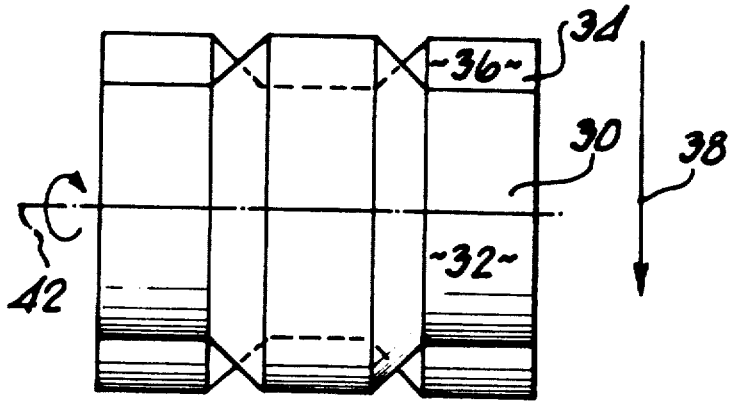
FIG. 4 shows, in plan, the grinding wheel employed in the second grinding step, the working surface of the grinding wheel having at this stage the appropriate form required for the first grinding step, and there is shown, in particular, the working surface being shaped by a tool having a complementary shaping surface to said appropriate form, the grinding wheel being presented to the shaping surface in the normal manner.
Figure 5:
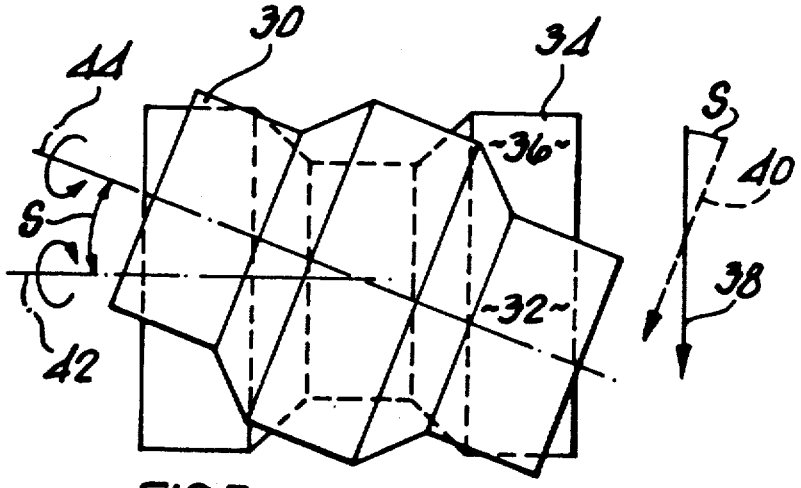
FIG. 5 shows, in plan, the grinding wheel employed in the second grinding step, but indicates the further shaping of the working surface thereof after the shaping shown in FIG. 4, this being achieved by the radially extending plane of the grinding wheel being inclined in one sense at a selected angle to the direction of this plane shown in FIG. 4, FIG. 5 not giving any detail of the alteration of the working surface thereby.

There is required for the second grinding step a grinding wheel with a working surface readily capable of re-shaping. Such a grinding wheel may comprise the grinding wheel 20 employed in the first grinding step, and shown in FIGS. 2 and 3 but, in this case, the wheel 20 requires re-shaping. More conveniently, however, a different grinding wheel 30, shown in FIGS. 4 to 6, is provided for the second grinding step, this wheel having the readily re-shapable working surface 32, and the working surface 24 of the grinding wheel 20 employed in the first grinding step is not so readily re-shapable. The working surface 32 is also provided by gemstone, or synthetic diamond, particles, having different sizes.

The working surface 32 is shaped by employing a tool 34, shown in FIGS. 4 and 5, and comprising a diamond faced former roller, the tool having a shaping surface 36 of the required form. The tool 34 traverses relative to the wheel 30, as indicated by the arrow 38, and is required to pass through the wheel. Usually the tool 34 is reciprocated, and reciprocation occurs until the tool has cut the full depth of its form into the wheel 30.

Initially, as shown in FIG. 4, the normal manner of presentation of the grinding wheel 30 to the tool 34 is employed, and the radially extending plane of the wheel is parallel to the direction of traverse as indicated by the arrow 38. In this manner, there is provided on the wheel 30 a working surface 32 of the same shape as that of the working surface 24 required for the wheel 20 employed in the first grinding step.

However, in the method in accordance with the present invention, the working surface 32 for the grinding wheel 30 to be employed in the second grinding step is required to be re-shaped to a different shape from that shown in FIGS. 2 and 3.

The desired altered shape for the working surface 32 of the grinding wheel 30 is obtained in the manner shown in FIG. 5, also by employing the tool 34. The detail of the alteration of the working surface is not shown in FIG. 5.

Instead of obtaining the shape of the working surface 24 of the grinding wheel 20 employed in the first grinding step obtained by presenting the grinding wheel 30 in the normal manner to the tool 34 (as shown in FIG. 4), the tool 34 traverses relatively to the wheel 30 as indicated by the arrow 38 (shown in FIG. 5), but with the radially extending plane of the grinding wheel 30 extending in a direction (indicated by the broken arrow 40 in FIG. 5) which is inclined to the arrow 38. This direction 40 is inclined in one sense at a selected angle S, in the range 1° to 20°, to the arrow 38.

The rotational axis of the wheel 30 is indicated at 42 in FIG. 4, and at 44 in FIG. 5. The axis 44 is inclined at the selected angle S to the direction of the axis 42 for the normal presentation of the wheel to the tool, as shown in FIG. 4, and is maintained in the same plane as that in which the rotational axis is maintained in the normal manner of presentation.

The grinding wheel 30 is then employed in the second grinding step, in the manner indicated in FIG. 6, which FIG. corresponds to FIG. 2 indicating the first grinding step.

In the second grinding step, the rotational axis of the grinding wheel 30 is caused to traverse relative to the required non-planar workpiece surface 12 provided in the first grinding step, and along the predetermined axis 14 (shown in FIG. 1), and parallel to the arrow 22. However, instead of the radially extending plane of the wheel 30 including the predetermined axis, this plane is inclined in said one sense at the selected angle S to the orientation of the radially extending plane in the first grinding step. In FIG. 6, a direction parallel to the orientation of the radially extending plane in the second grinding step is indicated by the broken arrow 46. The rotational axis of the wheel 30 is indicated at 50.

The altered working surface (not shown) of the grinding wheel 30 also has diamond particles protruding therefrom, by different amounts from the general level of the working surface. The pattern of diamond particle protrusion differs from that of the wheel 20. Further, the maximum particle protrusion for the wheel 30 is at most the same as the maximum particle protrusion for the wheel 20. Because, the radially extending plane of the grinding wheel 30 in the second grinding step is inclined at the selected angle S to the orientation of the radially extending plane of the grinding wheel 20 in the first grinding step, it is also inclined at the selected angle to the direction of the ridges 28 inevitably formed on the required workpiece surface 12 provided in the first grinding step. Thus, the protruding diamond particles enter the ridges 28 because of the rotation of the wheel 30, to grind the ridges and, at least, to reduce their height.

The arrangement is required to be such that it is unimportant if, in the second grinding step, the grinding wheel enters the side walls of the non-planar surface 12 of the workpiece 10 previously provided in the first grinding step.

The desired shape 24 of the grinding wheel 20 may be maintained by employing the tool 34 during the first grinding step, in the manner described above with reference to FIG. 4 for the normal presentation of the wheel to the tool. The axis of traverse of the wheel relative to the tool is parallel to the axis of traverse of the wheel relative to the workpiece, with the radially extending plane of the wheel during the first grinding step including both such axes of traverse.

The desired shape 32 of the grinding wheel 30 may be maintained by employing the tool 34 during the second grinding step, in the manner described above with reference to FIG. 5, the radially extending plane of the wheel being inclined in said one sense at the selected angle to the axis of traverse of the wheel relative to the tool, this axis of traverse being parallel to the axis of traverse of the wheel relative to the workpiece 10.

It is possible that the shaping tool 34 does not have a shaping surface 36 with the form shown in FIGS. 4 and 5. Instead the shaping tool has a different shape for the shaping surface to that of the illustrated tool 34, and is of a form such that the same required working surface of the grinding wheel is obtained by presenting the grinding wheel to the tool in the normal manner as shown in FIG. 4, and with radially extending plane of the grinding wheel including the axis of traverse of the wheel relative to the tool. Then, in the second grinding step, the radially extending plane of the wheel is inclined at the selected angle S, in said one sense, to the axis of traverse of the wheel relative to the workpiece, as shown in FIG. 2. The required shape for the tool can be generated conveniently by employing conventional computer-aided design techniques, and in section will be at least substantially the shape of the section of the workpiece 10 on the line 50 in FIG. 6.

With such an arrangement, the desired shape of the grinding wheel employed in the second grinding step may be maintained by employing the altered tool, and presenting this altered tool to the wheel in the normal manner, as described above with reference to FIG. 4. The axis of traverse of the wheel relative to the tool is inclined at the selected angle S to the axis of traverse of the wheel relative to the workpiece.

In one particular method in accordance with the present invention, the grinding wheel 20 has the maximum protrusion of the diamond particles in the range 39 to 180 microns, and the grinding wheel 30 has the maximum protrusion of the diamond particles in the range 6 to 39 microns. The shaping tool 34 has the maximum protrusion of the diamond particles at 4 microns.

The workpiece may be of any non-metallic material having a Vickers hardness value of up to 5000, and capable of being ground by the disintegration of the surface thereof, and the removal of small particles therefrom.

The gemstone, or synthetic diamond, particles may be bound in a working surface not readily reshapable by employing a suitable metal such as chromium, or a suitable metal alloy. Such a working surface may be formed by employing spark erosion techniques.

The gemstone, or synthetic diamond, particles may be bound in a working surface which is readily re-shapable by employing a vitreous binder, or by, for example, a binder comprising a mixture of copper and a suitable resin.

The general shape of a surface which can be provided on a hard, non-metallic, workpiece by a grinding method in accordance with the present invention has protrusions, and/or depressions, extending linearly parallel to the predetermined axis along which the grinding wheel, or wheels, traverse relative to the workpiece surface.

I claim:

1. A method of grinding a required non-planar surface configuration on to a workpiece made of non-metallic material and having a Vickers hardness value up to 5000, the method comprising a first and a second grinding step in each of which a grinding wheel, having a working surface of particles of a material selected from the group of gemstone and synthetic diamond, is applied to the workpiece-with the grinding wheel having a rotational axis which is traversed along a predetermined linear axis relative to the workpiece;

in the first grinding step, the grinding wheel being traversed with the predetermined axis lying in a radially extending plane of the grinding wheel, and the grinding wheel having a working surface shaped such that the workpiece is ground to be intermediate non-planar surface configuration with ridges thereon caused by said particles; and in the second grinding step, the grinding wheel having a working surface which has been shaped by a too, the tool having a shaping surface which, if the tool were presented with an axis of traverse of the wheel relative to the tool lying in said radially extending plane of the wheel, would shape the workpiece to said intermediate non-planar surface configuration, the tool, however, being presented with said radially extending plane of the grinding wheel inclined at a selected angle in the range 1 degree to 20 degrees to said linear axis of traverse of the wheel relative to the tool, and. in the second grinding step, said radially extending plane of the wheel being inclined at said selected angle to the inclination of said radially extending plane of the grinding wheel, to thereby shape the workpiece to said required non-planar surface configuration.

2. A method according to claim 1, in which the same grinding wheel is employed in both grinding steps.

3. A method according to claim 1, in which different grinding wheels are employed in the two grinding steps.

4. A method according to claim 1, in which the particles of the working surface of the grinding wheel employed in the first grinding step are bonded by a metal, or metal alloy.

5. A method according to claim 1, in which the particles of the working surface of the grinding wheel employed are bonded by a vitreous binder.

6. A method according to claim 1, in which the particles of the working surface of the grinding wheel employed are bonded by a binder comprising a mixture of copper and a resin.

7. A method according to claim 1, wherein the working surface of the grinding wheel used in the second grinding step has the same finish as the working surface of the grinding wheel used in the first grinding step.

8. A method according to claim 1, wherein the working surface of the grinding wheel used in the second grinding step is first shaped to have a working surface shaped similarly to the working surface of the grinding wheel employed in the first grinding step prior to shaping with said tool.

9. A method according to claim 1 wherein the working surface of the grinding wheel used in the second grinding step has a finer finish than the working surface of the grinding wheel used in the first grinding step.

* * * * *